US007673578B1

(12) United States Patent
Shanahan, III

(10) Patent No.: US 7,673,578 B1
(45) Date of Patent: Mar. 9, 2010

(54) MOORING DEVICE FOR BOATS

(76) Inventor: Richard James Shanahan, III, 1883 Calusa Ct., Marco Island, FL (US) 34145

( * ) Notice: Subject to any disclaimer, the term of this patent is extended or adjusted under 35 U.S.C. 154(b) by 8 days.

(21) Appl. No.: 12/185,926

(22) Filed: Aug. 5, 2008

(51) Int. Cl.
*B63B 21/00* (2006.01)

(52) U.S. Cl. ..... 114/230.18; 114/221 R; 114/230.17

(58) Field of Classification Search ..... 114/230.1, 114/230.11, 230.15, 230.16, 230.17, 230.18, 114/230.2, 230.26, 221 R
See application file for complete search history.

(56) References Cited

U.S. PATENT DOCUMENTS

| | | | | |
|---|---|---|---|---|
| 1,094,610 | A | 4/1914 | Steinhauer | |
| 2,640,534 | A | 6/1953 | Coffing | |
| 2,771,053 | A | 11/1956 | Gustafson | |
| 3,177,838 | A | 4/1965 | Grimes | |
| 3,224,404 | A | 12/1965 | De Jong | |
| 3,406,651 | A | 10/1968 | Jalbert | |
| 3,575,404 | A | 4/1971 | Wesch | |
| 3,863,591 | A | 2/1975 | Wild | |
| 4,178,869 | A | 12/1979 | Turrentine | |
| 4,250,827 | A | 2/1981 | Booker et al. | |
| 4,708,083 | A | 11/1987 | Billings | |
| 5,046,442 | A * | 9/1991 | Hay | 114/230.17 |
| 5,307,753 | A | 5/1994 | Besonen, Sr. et al. | |
| 5,408,946 | A | 4/1995 | Jones et al. | |
| 5,482,258 | A | 1/1996 | Clauson et al. | |
| 5,575,234 | A | 11/1996 | Dysarz | |
| 5,832,861 | A | 11/1998 | Taylor | |
| 6,659,033 | B1 | 12/2003 | Donley | |
| 7,000,908 | B2 | 2/2006 | Costello et al. | |
| 7,089,877 | B1 * | 8/2006 | Hay | 114/230.17 |

* cited by examiner

*Primary Examiner*—Lars A Olson
(74) *Attorney, Agent, or Firm*—Arthur Jacob

(57) ABSTRACT

A mooring device for mooring a boat at a selected nominal distance from a mooring point, with the boat being movable resiliently toward and away from the mooring point while biased into the selected nominal distance. First and second members are engaged with one another for movement relative to one another in longitudinal directions along the mooring device, and are resiliently biased, by a resilient biasing arrangement, into a nominal length which establishes the nominal distance. A band couples the first and second members for selected relative movement and enables ready adjustment of the length of the mooring device to any desired length within a range of length. A locking arrangement secures the band against movement to retain the first and second members at the selected length. Longitudinal forces exerted upon the mooring device are accommodated by the resilient biasing arrangement which militates against damage that might otherwise occur if the boat were held at a fixed distance from the mooring point or were permitted to collide with the mooring point.

16 Claims, 5 Drawing Sheets

MOORING DEVICE FOR BOATS

The present invention relates generally to boating and pertains, more specifically, to a mooring device for mooring a boat at a selected distance from a mooring point.

Boating has become increasingly popular, leading to the advent of a wider variety of boats better suited to the particular requirements of increasing numbers of boaters seeking to enjoy time spent on the water. While many different mooring devices have been made available for safely and effectively mooring a boat to a dock, the more effective currently available mooring devices generally are complex, relatively expensive, and cumbersome in both installation and use. The increasing number and variety of boats has been accompanied by a need for a more simple, yet effective device for mooring a boat with increased ease, and with greater safety.

The present invention provides a mooring device which meets the aforesaid need. As such, the present invention attains several objects and advantages, some of which are summarized as follows: Provides a mooring device of simple design and construction, enabling economical manufacture and ease of use; allows simplified adjustment to any one of a variety of specific mooring requirements; enables a safe and secure mooring arrangement which utilizes only a minimal number of mooring devices; allows a boat to be moored at a selected distance from a dock or other mooring point, with the distance being selectively adjustable to any distance within a given range of distance; provides a compact mooring device for ease of storage and ready deployment; is adapted readily for use in connection with boats of a variety of sizes and configurations in mooring these boats at various mooring locations; attains exceptional ease of use coupled with increased effectiveness in protecting a moored boat from damage resulting from a rigid connection to a mooring point or from a damaging encounter, such as a collision, with a mooring point; utilizes a minimum number of component parts of simple construction for economy of manufacture and for exemplary performance over a relatively long service life.

The above objects and advantages, as well as further objects and advantages, are attained by the present invention, which may be described briefly as a mooring device for mooring a boat at a selected nominal distance from a mooring point, with the boat being movable resiliently toward and away from the mooring point while biased into the selected nominal distance, the mooring device comprising: a first member extending in a longitudinal direction and having a near end a longitudinally opposite far end; a first attachment arrangement on the first member, adjacent the near end, for attaching the first member to the mooring point; a second member extending in the longitudinal direction and having a distal end and a longitudinally opposite proximal end; a second attachment arrangement on the second member, adjacent the distal end, for attaching the second member to the boat; the first and second members being engaged with one another for movement relative to one another in longitudinal directions, with the proximal end of the second member traveling between the near end and the far end of the first member, along opposite longitudinal directions; a resilient biasing arrangement coupling the proximal end of the second member with the first member, intermediate the near end and the far end of the first member, with the proximal end of the second member placed at an equilibrium position located intermediate the near end and the far end of the first member, the resilient biasing arrangement enabling movement of the proximal end of the second member between the near end and the far end of the first member in longitudinally opposite directions away from the equilibrium position while biasing the proximal end of the second member into the equilibrium position; and an adjustment arrangement for selectively placing the equilibrium position at a selected location relative to both the near end and the far end of the first member to establish a selected longitudinal length between the near end of the first member and the distal end of the second member to place the boat at the selected nominal distance from the mooring point; the adjustment arrangement including a band extending longitudinally along the first member, between the near end and the far end of the first member, the proximal end of the second member being coupled with the band such that movement of the band relative to the first member will place the equilibrium position at the selected location.

The invention will be understood more fully, while still further objects and advantages will become apparent, in the following detailed description of preferred embodiments of the invention illustrated in the accompanying drawing, in which.

Figure 1:
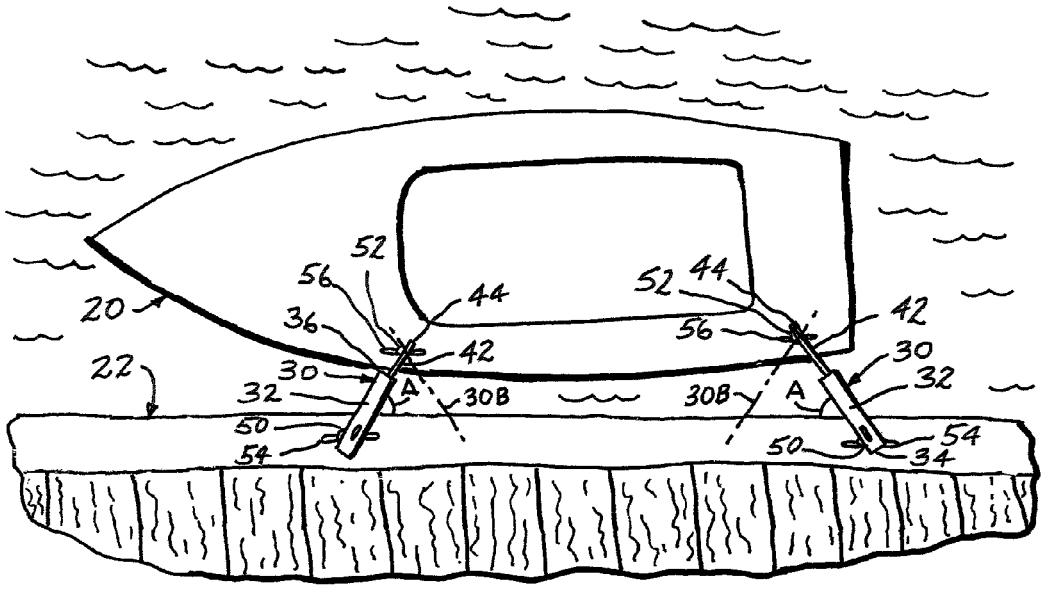
FIG. 1 is a somewhat diagrammatic, pictorial plan view showing a boat moored at a mooring location utilizing mooring devices constructed in accordance with the present invention.
Figure 2:
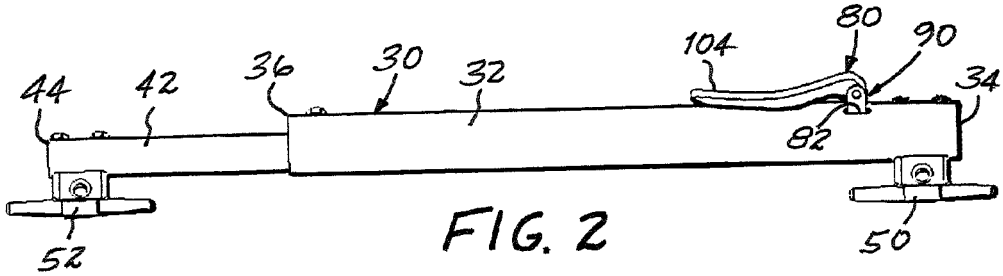
FIG. 2 is an enlarged pictorial elevational view of a mooring device such as shown in FIG. 1.
Figure 3:
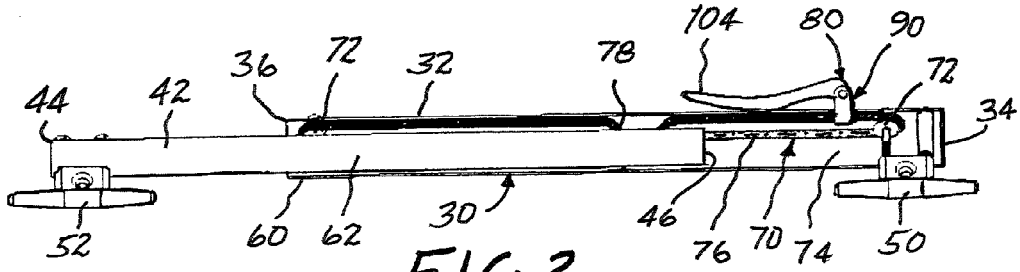
FIG. 3 is a somewhat pictorial view similar to FIG. 2, and longitudinally sectioned to reveal inner component parts.

Referring now to the drawing, and especially to FIGS. 1 through 5 thereof, a boat 20 is shown moored to a mooring location in the form of a dock 22, utilizing two mooring devices 30 constructed in accordance with the present invention. Each mooring device 30 includes a first member 32, having a near end 34 and a longitudinally opposite far end 36, and a second member 42, having a distal end 44 and a longitudinally opposite proximal end 46. A first attachment arrangement adjacent the near end 34 of the first member 32 includes a cleat 50 affixed to the first member 32 adjacent the near end 34 of the first member 32, and a second attachment arrangement adjacent the distal end 44 of the second member 42 includes a cleat 52 affixed to the second member 42 adjacent the distal end 44 of the second member 42. Each cleat 50 is secured to a corresponding mooring point in the form of a block 54 affixed to the dock 22, and each distal end 44 is secured to a corresponding mooring element 56 affixed to the boat 20. Each first member 32 is engaged with a corresponding second member 42 adjacent the far end 36 and the proximal end 46 of the first and second members 32 and 42, respectively, to provide each mooring device 30 with a longitudinal length between ends 34 and 44 selected to place the boat 20 at a desired nominal distance from each mooring point, and spaced appropriately from the dock 22, as set forth in greater detail below.

Turning now to FIGS. 2 through 10, the first and second members 32 and 42 of mooring device 30 preferably are in the form of tubular members having respective tubular walls 60 and 62 constructed of a relatively stiff, corrosion-resistant material, such as aluminum. The second member 42 is received within the first member 32 in a sliding arrangement, with the proximal end 46 of the second member 42 entering through the far end 36 of the first member 32, in a manner similar to telescopic engagement. A band 70 is looped around pulleys 72 journaled for rotation within the interior 74 of the first member 32 such that the band 70 is free to move along a looped path of travel 76 defined by engagement of the band 70 with the pulleys 72. In the preferred construction, band 70 is in the form of a continuous loop and the looped path of travel 76 lies within the interior 74 of the first member 32 and outside the second member 42, between the first and second members 32 and 42. Band 70 is coupled with second member 42 at 78, adjacent the proximal end 46 of the second member 42, such that band 70 traverses looped path of travel 76 in response to longitudinal movement of the second member 42 within the first member 32. In this manner, the overall length of mooring device 30, between ends 34 and 44, is selectively adjustable to any desired length within a range of longitudinal length.

Figure 4:
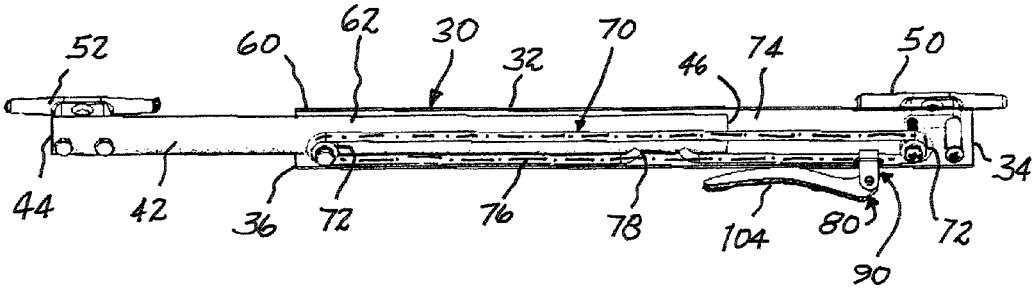
FIG. 4 is a view similar to FIG. 3, but with the mooring device rotated about the longitudinal direction.
Figure 5:
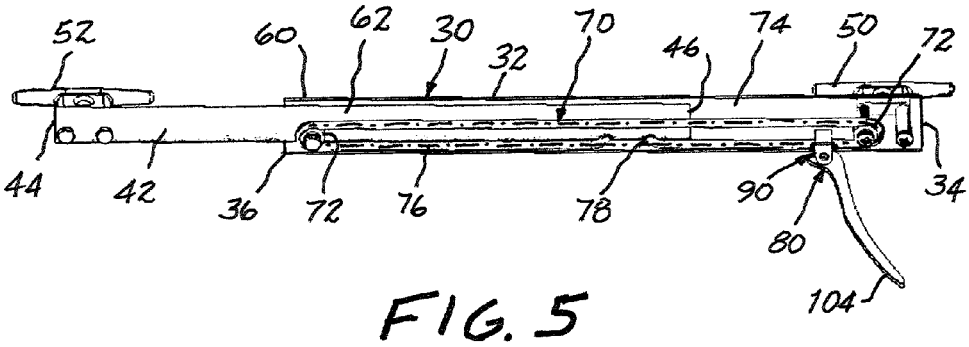
FIG. 5 is a view similar to FIG. 4, and showing component parts in an unlocked configuration.
Figure 6:
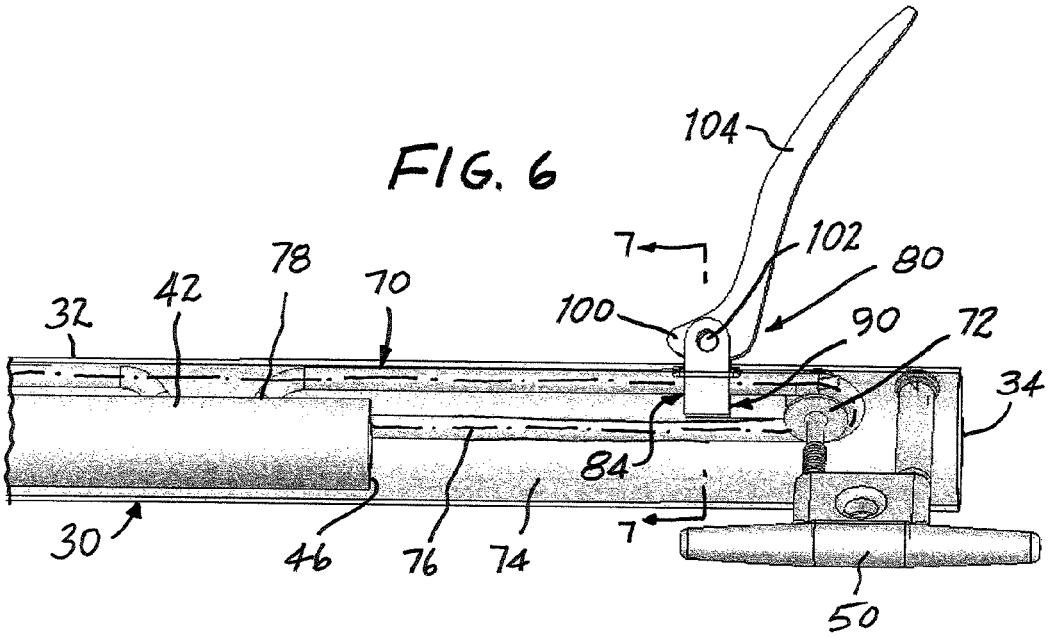
FIG. 6 is a further enlarged, fragmentary view rendered in phantom and showing the component parts in the unlocked configuration.
Figure 7:
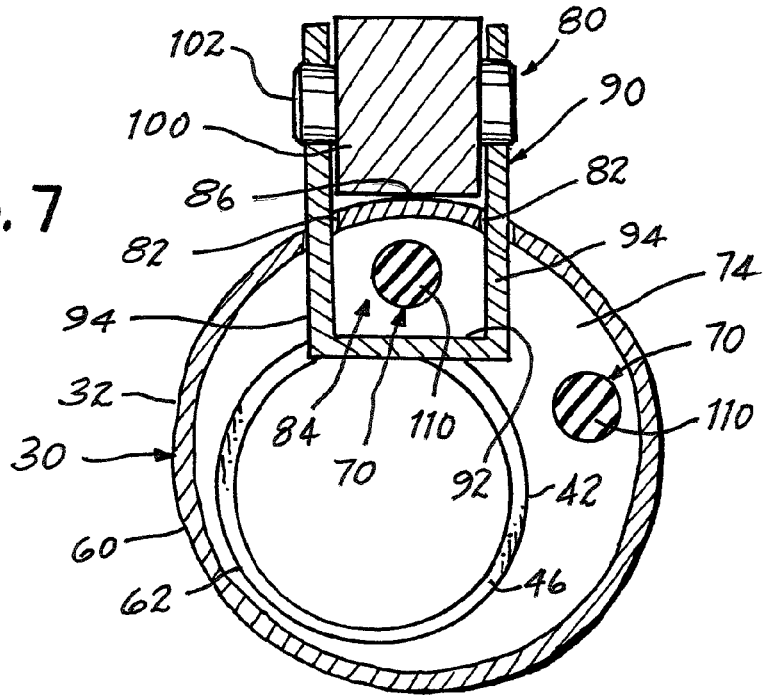
FIG. 7 is an enlarged cross-sectional view taken along line 7-7 of FIG. 6.
Figure 8:
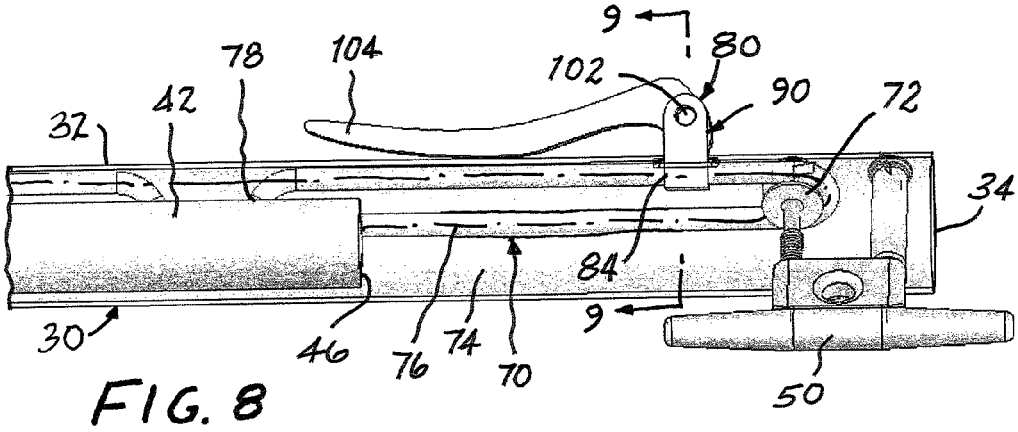
FIG. 8 is a fragmentary view similar to FIG. 6, but showing the component parts in a locked configuration.
Figure 9:
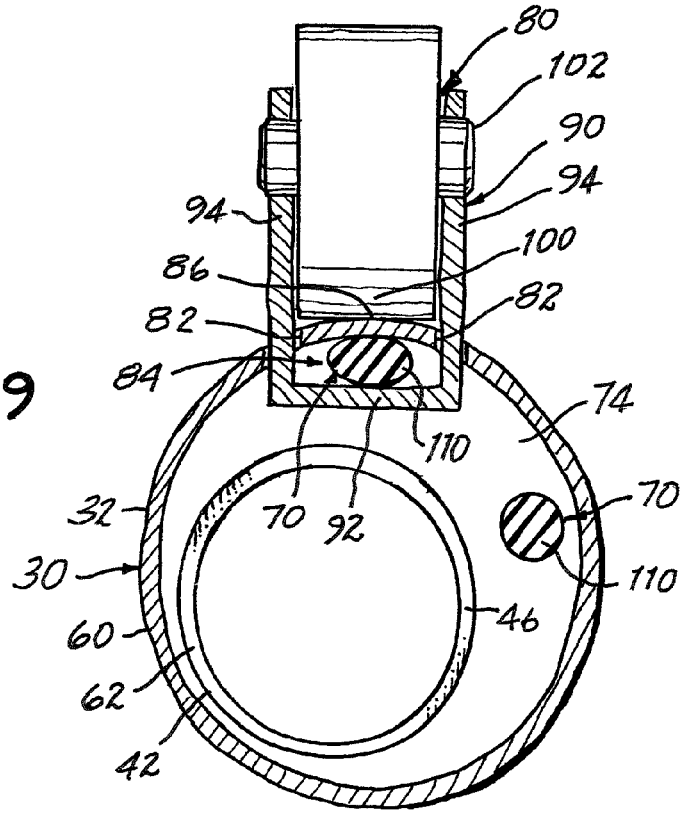
FIG. 9 is an enlarged cross-sectional view taken along line 9-9 of FIG. 8.

Once the desired length is selected, a locking arrangement 80 is operated to lock the band 70 against further movement. Thus, as best seen in FIGS. 6 through 9, a pair of slots 82 pass through wall 60 of the first member 32 and are juxtaposed with the band 70 at a locking location 84, extending at either side of a segment 86 of wall 60. A U-shaped clamp 90 straddles the band 70 at the locking location 84 and includes a platen 92 carried by a pair of legs 94 which extend from the platen 92 and pass through the slots 82, with the band 70 threaded between the platen 92 and the wall 60. A cam 100 is mounted for rotation between the legs 94, by a pin 102, and a lever 104 is integral with cam 100 such that upon grasping the lever 104, an operator can move the cam 100 selectively between an unlocked position, as seen in FIGS. 5, 6 and 7, and a locked position, as seen in FIGS. 4, 8 and 9. In the unlocked position of cam 100, the platen 92 is moved away from the wall 60 and the band 70 is free to move along the looped path of travel 76, thereby enabling the selection of a desired length for mooring device 30. Upon moving the cam 100 to the locked position, the cam 100 will bear against segment 86 along the exterior of wall 60, drawing the platen 92 toward the interior of the wall 60 and clamping the band 70 against further movement, thereby fixing the length of mooring device 30 at the desired, selected length. In this manner, the length of the mooring device 30 is adjusted to any selected length within the range of travel permitted by movement of the band 70. Cleats 50 and 52 are bolted to respective first and second members 32 and 42, adjacent ends 34 and 44, and are available for securement of the mooring device 30 between the boat 20 and the dock 22 either before or after the selection of a desired length of mooring device 30.

Figure 10:
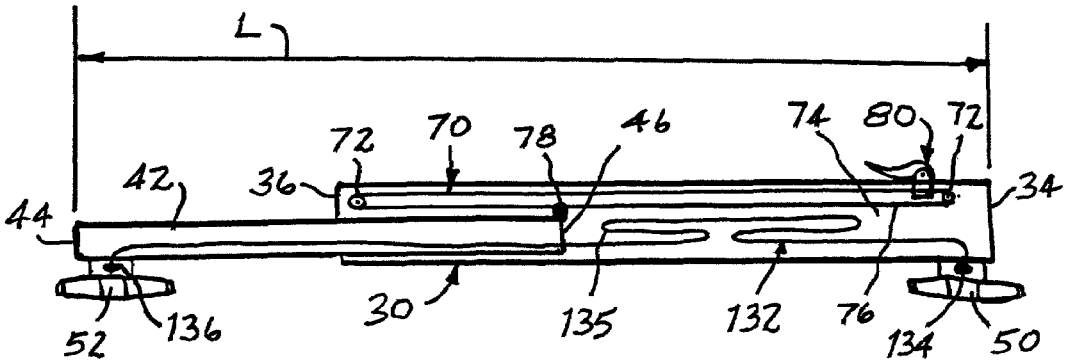
FIG. 10 is a diagrammatic illustration of the mooring device.

Band 70 is in the form of an elastic cord 110, commonly known as a "bungee" cord, such that band 70 serves in a resilient biasing arrangement which enables some resiliently biased relative movement between the first and second members 32 and 42 when the locking arrangement 80 is in the locked configuration. Referring now to FIG. 10, as well as to FIGS. 2 through 9, with the locking arrangement 80 in the locked configuration, proximal end 46 of the second member 42 is located at an equilibrium position 130 intermediate the near and far ends 34 and 36 of the first member 32, thereby establishing length L, between ends 34 and 44, as a nominal length. Upon encountering external forces tending to move the boat 20 toward or away from the dock 22, the proximal end 46 of second member 42 is able to move away from the equilibrium position 130, against the resilient bias of band 70, either toward or away from the near end 34 of the first member 32, thereby militating against any damage which otherwise might occur through a rigid connection between the boat 20 and the dock 22, or through a deleterious encounter, such as a collision, between the boat 20 and the dock 22. The adjustment arrangement provided by the band 70 and the locking arrangement 80 enables a simple and effective mechanism for selecting the desired nominal length L and then fixing the mooring device 30 at that nominal length.

As an optional safety feature, cleats 50 and 52 may be tethered to one another in order to preclude a complete disconnection of boat 20 from dock 22 in the event of a catastrophic failure of band 70, first member 32 or second member 42. Thus, as shown in FIG. 10, a tether 132 has been placed within mooring device 30, one end of the tether 132 being affixed to cleat 50, at 134, and the other end of the tether 132 being affixed to cleat 52, at 136. Tether 132 has a length, looped at 135, sufficient to assure that the tether 132 will in no way interfere with the adjustment and operation of mooring device 30, as described above, and comes into play only if needed to avoid a complete separation of the boat 20 from the dock 22.

The construction of mooring device 30 enables the use of only two mooring devices 30, each set at an acute angle A relative to the dock 22, as seen in FIG. 1, to attain the desired resilient stand-off of the boat 20 from the dock 22. By placing acute angles A so that the two mooring devices 30 are oriented in a configuration converging toward boat 20, as shown in FIG. 1, or in a diverging configuration, as illustrated diagrammatically by phantom lines 30B, and setting the magnitude of angles A such that the converging (or diverging) configuration is maintained throughout any movement of the boat 20 away from the nominal distance, as permitted by the resilient biasing arrangement in each mooring device 30, the desired resilient stand-off will be retained, utilizing only two mooring devices 30, with no supplemental mooring apparatus being necessary.

Figure 11:
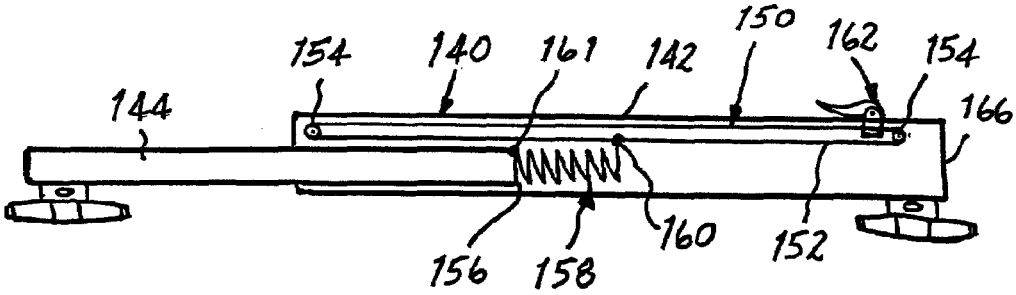
FIG. 11 is a diagrammatic illustration showing another embodiment of the present invention.

Referring now to FIG. 11, in an alternate embodiment, a mooring device 140 utilizes first and second members 142 and 144 engaged with one another in a manner similar to first and second members 32 and 42 of mooring device 30. However, in mooring device 140, a band 150, arranged to follow a looped path of travel 152 around pulleys 154 as in mooring device 30, is not constructed of a resiliently expanded or contracted material. Rather, band 150 is constructed of an essentially non-resilient material, such as a rope or a non-elastic belt, and is coupled to the proximal end 156 of second member 144 through a helical spring 158 interposed longitudinally between the band 150 and the proximal end 156 of the second member 144. Spring 158 is affixed to the band 150 at 160 and the band 150 is movable along the looped path of travel 152 such that an equilibrium position 161 of the proximal end 156 of second member 144 is selectively movable to adjust the length of mooring device 140 to a selected nominal length. Once the length of mooring device 140 is selected, a locking arrangement 162 secures the band 150 against further movement and thereby fixes the location of the equilibrium position 161. Longitudinal forces exerted upon the mooring device 140 will tend to move the second member 144 relative to the first member 142, in either one of both longitudinal directions relative to the near end 166 of the first member 142, and helical spring 158 will bias the proximal end 156 of the second member 144 into the equilibrium position 161.

Figure 12:
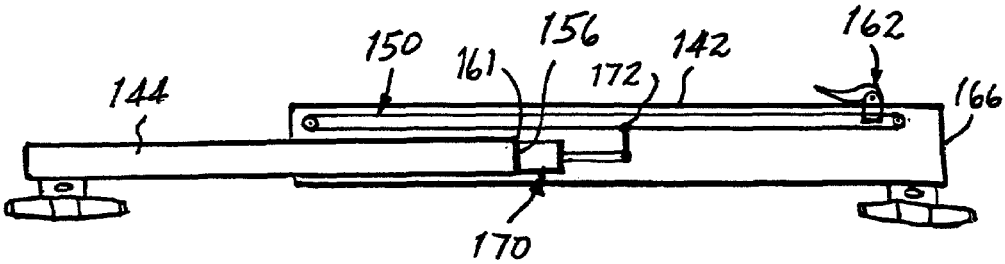
FIG. 12 is a diagrammatic illustration similar to FIG. 11, and showing a further embodiment of the present invention.

In the embodiment illustrated in FIG. 12, helical spring 158 of mooring device 140 has been replaced by a shock absorber 170 interposed between the proximal end 156 of the second member 144 and the band 150, the shock absorber 170 being affixed to the band 150 at 172. The selected nominal length of the mooring device 140 is attained as before, by moving the band 150 to move equilibrium position 161. Longitudinal forces of higher magnitude will tend to move the proximal end 156 of the second member 144 away from equilibrium position 161 and will be damped and absorbed by shock absorber 170. As before, the proximal end 156 of the second member 144 will be biased resiliently into the equilibrium position 161 to maintain the selected nominal length of mooring device 140.

It will be seen that the present invention attains all of the objects and advantages summarized above, namely: Provides a mooring device of simple design and construction, enabling economical manufacture and ease of use; allows simplified adjustment to any one of a variety of specific mooring requirements; enables a safe and secure mooring arrangement which utilizes only a minimal number of mooring devices; allows a boat to be moored at a selected distance from a dock or other mooring point, with the distance being selectively adjustable to any distance within a given range of distance; provides a compact mooring device for ease of storage and ready deployment; is adapted readily for use in connection with boats of a variety of sizes and configurations in mooring these boats at various mooring locations; attains exceptional ease of use coupled with increased effectiveness in protecting a moored boat from damage resulting from a rigid connection to a mooring point or from a damaging encounter, such as a collision, with a mooring point; utilizes a minimum number of component parts of simple construction for economy of manufacture and for exemplary performance over a relatively long service life.

It is to be understood that the above detailed description of preferred embodiments of the present invention is provided by way of example only. Various details of design and construction may be modified without departing from the true spirit and scope of the invention as set forth in the appended claims.

The embodiments of the invention in which an exclusive property or privilege is claimed are defined as follows:

1. A mooring device for mooring a boat at a selected nominal distance from a mooring point, with the boat being movable resiliently toward and away from the mooring point while biased into the selected nominal distance, the mooring device comprising:

a first member extending in a longitudinal direction and having a near end a longitudinally opposite far end;

a first attachment arrangement on the first member, adjacent the near end, for attaching the first member to the mooring point;

a second member extending in the longitudinal direction and having a distal end and a longitudinally opposite proximal end;

a second attachment arrangement on the second member, adjacent the distal end, for attaching the second member to the boat;

the first and second members being engaged with one another for movement relative to one another in longitudinal directions, with the proximal end of the second member traveling between the near end and the far end of the first member, along opposite longitudinal directions;

a resilient biasing arrangement coupling the proximal end of the second member with the first member, intermediate the near end and the far end of the first member, with the proximal end of the second member placed at an equilibrium position located intermediate the near end and the far end of the first member, the resilient biasing arrangement enabling movement of the proximal end of the second member between the near end and the far end of the first member in longitudinally opposite directions away from the equilibrium position while biasing the proximal end of the second member into the equilibrium position; and an adjustment arrangement for selectively placing the equilibrium position at a selected location relative to both the near end and the far end of the first member to establish a selected longitudinal length between the near end of the first member and the distal end of the second member to place the boat at the selected nominal distance from the mooring point;

the adjustment arrangement including a band extending longitudinally along the first member, between the near end and the far end of the first member, the proximal end of the second member being coupled with the band such that movement of the band relative to the first member will place the equilibrium position at the selected location.

2. The mooring device of claim 1 wherein the band comprises an elastic cord.

3. The mooring device of claim 2 wherein the elastic cord is affixed to the second member adjacent the proximal end of the second member.

4. The mooring device of claim 3 wherein the band follows a looped path of travel.

5. The mooring device of claim 1 wherein the band follows a looped path of travel.

6. The mooring device of claim 1 wherein at least the first member comprises a tubular member having an interior, and the second member extends within the interior of the first member for sliding movement relative to the first member.

7. The mooring device of claim 6 wherein the band follows a looped path of travel.

8. The mooring device of claim 7 wherein the looped path of travel is located within the interior of the first member.

9. The mooring device of claim 8 including a locking arrangement on the first member for selectively securing the band against movement along the looped path of travel.

10. The mooring device of claim 9 wherein the locking arrangement includes a clamp for selectively clamping the band to the first member.

11. The mooring device of claim 6 wherein the band comprises an elastic cord.

12. The mooring device of claim 11 wherein the elastic cord is affixed to the second member adjacent the proximal end of the second member.

13. The mooring device of claim 12 wherein the band follows a looped path of travel.

14. The mooring device of claim 13 wherein the looped path of travel is located within the interior of the first member.

15. The mooring device of claim 14 including a locking arrangement on the first member for selectively securing the band against movement along the looped path of travel.

16. The mooring device of claim 15 wherein the locking arrangement includes a clamp for selectively clamping the band to the first member.

* * * * *